US006968771B2

(12) United States Patent
Tikkanen

(10) Patent No.: US 6,968,771 B2
(45) Date of Patent: Nov. 29, 2005

(54) ACTUATOR CYLINDER

(75) Inventor: Timo Tikkanen, Porvoo (FI)

(73) Assignee: Alamarin-Jet Oy, Keuruu (FI)

( * ) Notice: Subject to any disclaimer, the term of this patent is extended or adjusted under 35 U.S.C. 154(b) by 0 days.

(21) Appl. No.: 10/496,556

(22) PCT Filed: Dec. 20, 2002

(86) PCT No.: PCT/FI02/01048

§ 371 (c)(1),
(2), (4) Date: May 25, 2004

(87) PCT Pub. No.: WO03/058095

PCT Pub. Date: Jul. 17, 2003

(65) Prior Publication Data

US 2005/0000350 A1 Jan. 6, 2005

(30) Foreign Application Priority Data

Dec. 20, 2001 (FI) ..... 20012524
Jul. 24, 2002 (FI) ..... 20025035

(51) Int. Cl.[7] ..... F15B 9/10
(52) U.S. Cl. ..... 91/375 R; 91/380
(58) Field of Search ..... 91/375 R, 380, 91/403

(56) References Cited

U.S. PATENT DOCUMENTS 2,917,079 A * 12/1959 Deford et al. ..... 91/375 R
2,954,837 A * 10/1960 Ziskal ..... 91/380
3,242,824 A * 3/1966 Jablonsky et al. ..... 91/380
3,913,449 A * 10/1975 Koch et al. ..... 91/380
3,915,070 A * 10/1975 Mailliet ..... 92/5 R
4,386,552 A * 6/1983 Foxwell ..... 91/1
4,418,781 A 12/1983 Rabe et al.
4,475,440 A 10/1984 Rabe et al.
6,116,139 A 9/2000 Yuda, Jr. et al.

* cited by examiner

*Primary Examiner*—Edward K. Look
*Assistant Examiner*—Michael Leslie
(74) *Attorney, Agent, or Firm*—Fildes & Outland, P.C.

(57) ABSTRACT

The invention relates to an actuator cylinder, which is intended to be operated using a control valve controlled by an operating lever. The actuator cylinder includes a cylinder barrel, a piston, and a rod, which extends outside the cylinder barrel. A detector element is fitted in connection with the rod, its angle of rotation corresponding to the current position of the piston. The control valve includes a rotatably supported slide construction, to which the detector element is connected in order to rotate the slide construction to a free-circulation position, when the piston is in a position according to the operating lever. The control valve also includes connections, between which a through-flow channel is arranged. The slide construction additionally includes a component shutting off the through-flow channel.

10 Claims, 7 Drawing Sheets

ACTUATOR CYLINDER

TECHNICAL FIELD

The present invention relates to an actuator cylinder, which is intended to be connected to a pressure-medium system and to be operated using a control valve controlled by an operating lever, which control valve is arranged in connection with the actuator cylinder, and which actuator cylinder includes

- a cylinder barrel and a piston sealed and arranged to move inside it,
- a rod attached to the piston, which rod extends outside the cylinder barrel at one end of it,
- a detector element fitted in connection with the rod, which detector element is arranged to be rotatable around its longitudinal axis, in such a way that its angle of rotation corresponds to the current position of the piston relative to the cylinder barrel, and
- connections to lead the pressure medium to the piston, according to the position of the control valve, in which actuator cylinder the control valve includes a rotatably supported and multi-part coaxial slide construction, to which the detector element is connected in order to rotate the slide construction to a free-circulation position, when the piston is in a position according to the operating lever.

BACKGROUND OF THE INVENTION

Usually, both hydraulic and pneumatic actuator cylinders are designed to be used in such a way that the piston of the actuator cylinder moves from one end position to the other. In other words, the most important aspect is the effective movement created by the actuator cylinder, its positioning being of secondary importance. Thus, the actuator cylinder is operated using a simple control valve, which is a mechanical or electrical direction valve. However, the operating lever of the control valve must be kept turned the whole time until the piston reaches the desired position. In addition, actuator cylinders used for steering are quite small, so that even a small movement of the operating lever will move the piston rapidly for a long distance. This makes the steering jerky while the sudden movements can damage the structures attached to the actuator cylinder. Further, the control valve must be installed next to the operator, due to the small movement of the operating lever. This requires hose runs between the actuator cylinder and the control valve. In addition, the position of the piston cannot be predefined when using conventional control valves.

Particularly in steering applications, devices based on air springs or electric motors have also been developed, in which the operating lever can be turned directly to the desired position. These devices are, however, complicated and their use in, for instance, means of water transport demands especially watertight protection. In addition, the known devices are slow and demand a great deal of energy.

U.S. Pat. No. 3,915,070 discloses an actuator cylinder, in which there is also a detector element indicating the position of the piston. In the disclosed actuator cylinder, the longitudinal movement of the piston is converted to a rotating movement of the detector element, which shows the position of the piston in relation to the cylinder barrel. In this case too, the actuator cylinder is controlled using a conventional control valve, so that, despite the detector element, when used in steering the actuator cylinder moves in jerks. In addition, it is difficult to exploit the position data in steering, as the indicator connected to the detector element is located at the end of the actuator cylinder, or at least close to it.

U.S. Pat. No. 4,475,440 discloses one kind of actuator cylinder, in connection with which a control valve is arranged. This is a steering booster using particularly in vehicles. In the control valve, there is a special slide construction, to which the detector element is connected with the aid of a herringbone gear. Thus, when the piston reaches the position determined by the steering wheel, the slide construction has correspondingly rotated to the neutral position, guided by the detector element.

The actuator cylinder referred to above is large and contains a great many complicated components. In addition, the control valve is an extension of the actual cylinder barrel and contains a large number of pieces that are difficult to machine. In addition, the body of the control valve has several channels that must be machined, which complicates the manufacture of the actuator cylinder. Further, the detector element has several components and it has to be steadily fitted with a bearing to the cylinder barrel. Due to the numerous channels and complicated components, the flow resistance of the pressure medium is high. In addition, in the neutral position of the slide construction, the pressure is released on both sides of the piston. In other words, the actuator cylinder lacks a so-called holding property, so that external forces can affect the position of the piston.

SUMMARY OF THE INVENTION

The invention is intended to create a new type of actuator cylinder, which can be more easily and precisely controlled than before, but the construction of which is simpler and more reliable in operation than earlier. The characteristic features of this invention, which is intended to be connected to a pressure-medium system and to be operated using a control valve controlled by an operating lever, which control valve is arranged in connection with the actuator cylinder, and which actuator cylinder includes

- a cylinder barrel and a piston sealed and arranged to move inside it,
- a rod attached to the piston, which rod extends outside the cylinder barrel at one end of it,
- a detector element fitted in connection with the rod, which detector element is arranged to be rotatable around its longitudinal axis, in such a way that its angle of rotation corresponds to the current position of the piston relative to the cylinder barrel, and
- connections to lead the pressure medium to the piston, according to the position of the control valve, in which actuator cylinder the control valve includes a rotatably supported and multi-part coaxial slide construction, to which the detector element is connected in order to rotate the slide construction to a free-circulation position, when the piston is in a position according to the operating lever, and in order to connect the actuator cylinder to the pressure-medium system, the control valve includes connections between which a through-flow channel is arranged, and the slide construction additionally includes a component shutting off the through-flow channel, is characterized in that, the slide construction has a three-part structure including an outer part and a middle part and an inner part, and the outer part and the inner part are attached to each other, and the middle part forming the component is connected to the detector element, while the through-flow channel goes through the middle part.

In a specific embodiment, the through-flow channel may be formed in the slide construction, and there may be two connections arranged on opposite sides of the cylinder barrel at the same level in the longitudinal direction of the cylinder barrel. The control valve may be arranged to form part of the actuator cylinder inside the body piece forming the cylinder barrel, and the axis of rotation of the slide construction may be essentially the same as that of the detector element. The control valve may include a valve body connected to the operating lever, which is also rotatably supported in relation to the cylinder barrel, and in which some of the connections are arranged. The slide construction may include a slide, which is arranged inside the valve body so that both can be freely rotated relative to the other, to which slide the detector element is attached. The valve body may include two guide pieces set inside each other and arranged in cooperation, between which the slide is arranged rotatably in relation to both the valve body and the cylinder barrel to guide the pressure medium. In the guide pieces there may be channels that are both radial and longitudinal to the cylinder barrel for the pressure medium, which channels the slide is arranged to close in free-circulation position. In order to lead the pressure medium to the rod side of the piston the actuator cylinder may include boreholes that are longitudinal and radial to the cylinder barrel, arranged in the wall of the cylinder barrel. The operating lever and the control valve may be arranged in such a way that the maximum movement of the operating lever corresponds at most to the maximum rotation of the detector element. The maximum movement of the operating lever may form an angle $\alpha$, which is 80°–130°, preferably 90°–120°, which essentially corresponds to the entire stroke of the rod of the actuator cylinder.

In the actuator cylinder according to the invention, the control valve is arranged in such a way that the piston moves precisely to the position shown by the operating lever of the control valve. In addition, the operating lever can be moved independently of the position of the piston once the piston has finally settled to the position shown by the operating lever. Thus, the actuator cylinder is particularly suitable to be applied as a steering cylinder, allowing precise and smooth steering to be achieved. In addition, the control valve is preferably arranged in connection with the actuator cylinder, which further simplifies the construction of the total installation. Further, the control valve is small in size but of rugged construction. In addition, the new form of construction means that flow losses are extremely small, especially when the control valve is in the free-circulation position. The actuator cylinder is particularly suitable for means of water transport, as operation of the control valve of the actuator cylinder is entirely mechanical, without electrical components. This also reduces the actuator cylinder's need for maintenance and increases the operating reliability of the actuator cylinder. In addition, the actuator cylinder is extremely compact, as the cylinder barrel for part of the control valve.

These and other features and advantages of the invention will be more fully understood from the following detailed description of the invention taken together with the accompanying drawings.

DETAILED DESCRIPTION OF THE INVENTION

Figure 1:
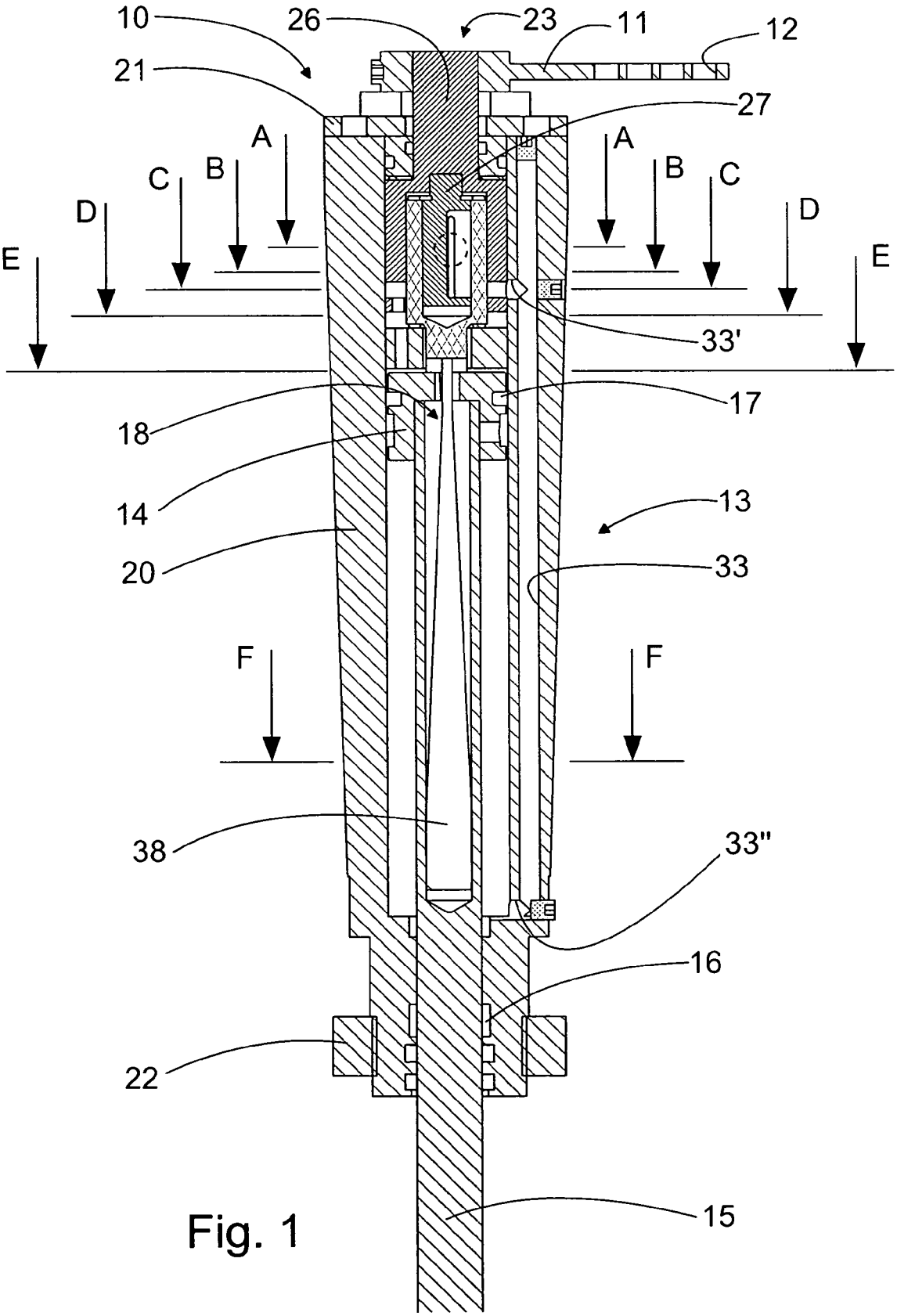
FIG. 1 shows a cross-section of the actuator cylinder according to the invention.
Figure 2A:
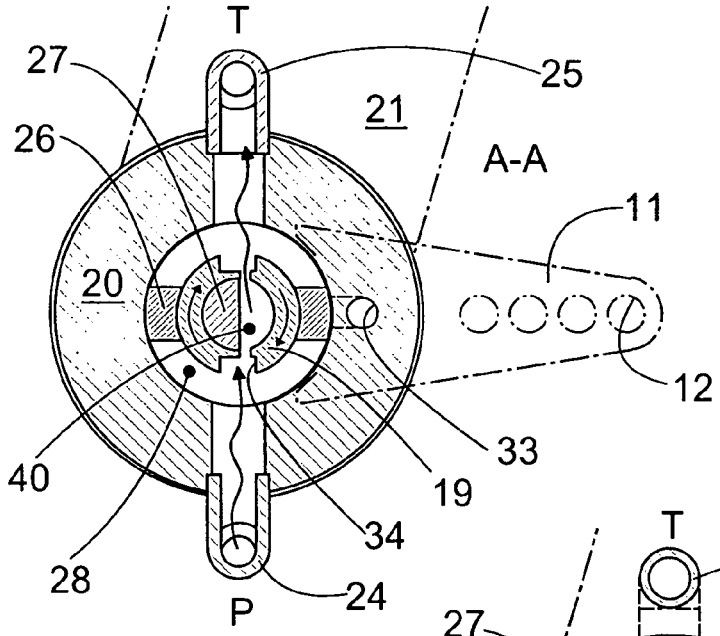
FIG. 2*a* shows a cross-section of the actuator cylinder of FIG. 1 at level A—A.
Figure 2B:
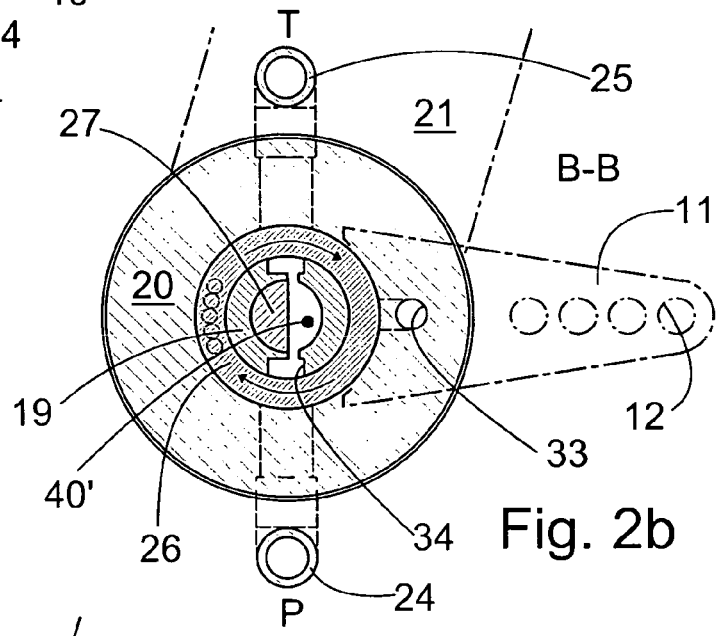
FIG. 2*b* shows a cross-section of the actuator cylinder of FIG. 1 at level B—B.
Figure 2C:
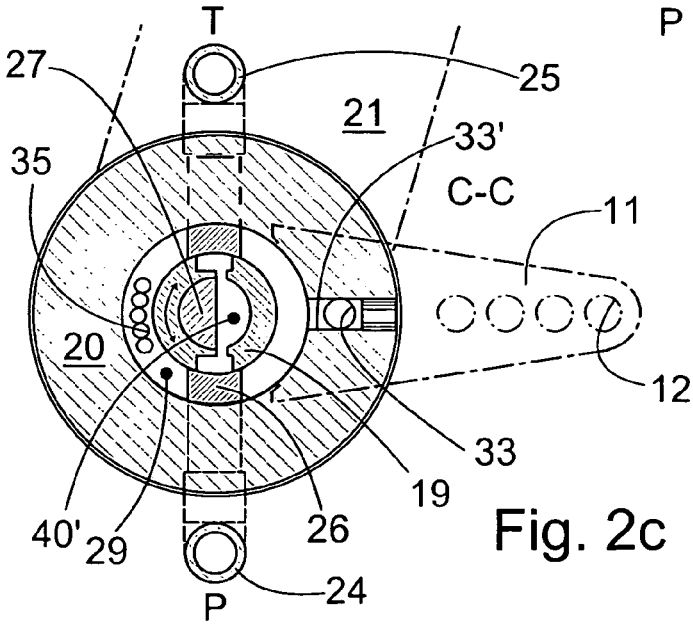
FIG. 2*c* shows a cross-section of the actuator cylinder of FIG. 1 at level C—C.
Figure 3A:
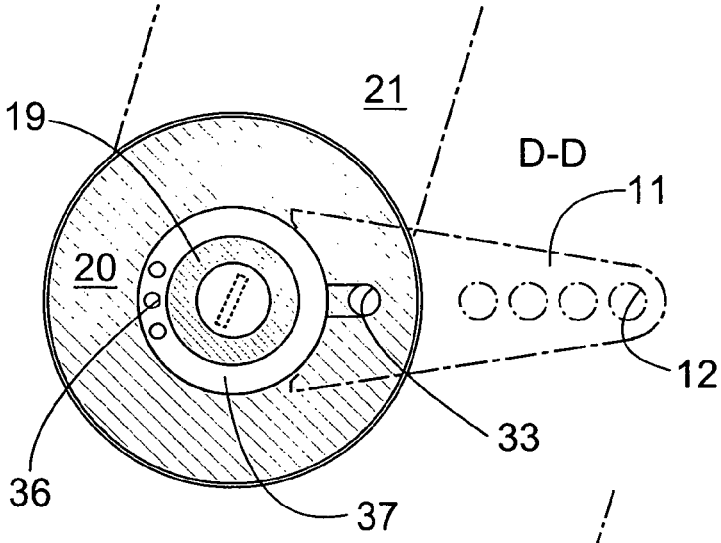
FIG. 3*a* shows a cross-section of the actuator cylinder of FIG. 1 at level D—D.
Figure 3B:
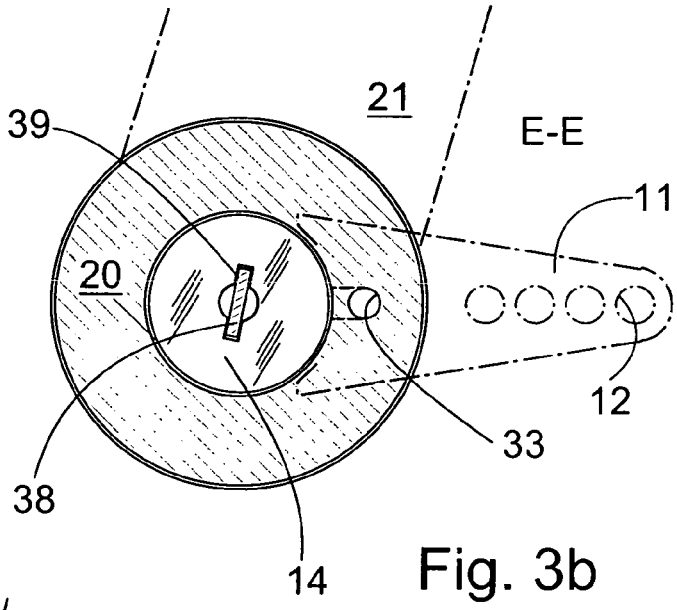
FIG. 3*b* shows a cross-section of the actuator cylinder of FIG. 1 at level E—E.
Figure 3C:
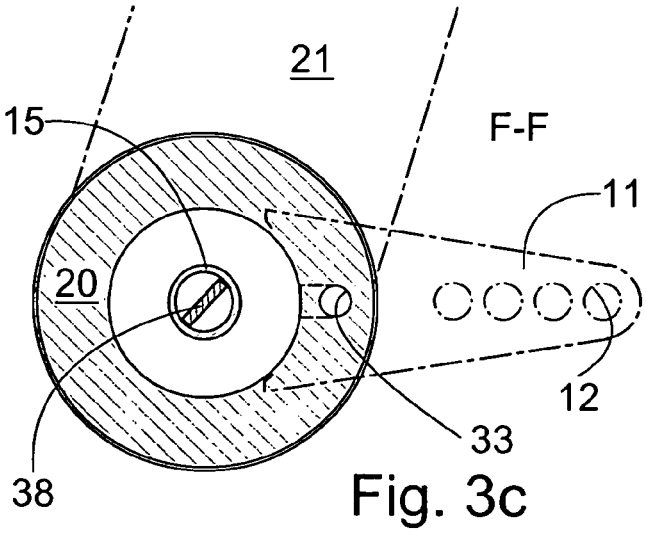
FIG. 3*c* shows a cross-section of the actuator cylinder of FIG. 1 at level F—F.

FIG. 1 shows a cross-section of the actuator cylinder according to the invention. Differing from the figure, the actuator cylinder, hereinafter simply the cylinder, can be installed in any position at all, as required in the case in question. The cylinder according to the invention is intended for use particularly as a steering cylinder, in which precision and ease of operation take precedence over high power. However, despite its small size, the use of the cylinder achieves greater power, as well as faster but more precise movement than the use of known devices. On the other hand, the power of the cylinder can be increased simply, for example, by increasing the size and capacity of the cylinder.

The cylinder is connected to a pressure-medium system, which in practice is either a pneumatic or a hydraulic system (not shown). The cylinder is operated by means of a control valve 10, which is correspondingly controlled using an operating lever 11. According to the figures, there are suitable attachment points 12 in the operating lever 11 for attaching, for example, pivots, and thus for transmitting steering commands, for instance from a steering wheel, to the control valve. One tested application has been the control cylinder of the scoop of a jet ski, for which the cylinder according to the invention is preeminently suitable. The basic components of the cylinder include a cylinder barrel 13 and a piston 14 that is sealed and arranged to move inside it. In FIG. 1, the piston 14 is shown at one end position. In addition, a rod 15, which extends outside the cylinder barrel 13, is attached to the piston 14. The rod together with the piston are the parts that move in the longitudinal direction of the cylinder, while the other components remain stationary. Thus, the rod is attached to the actual structure to be moved, such as, for example, the steering arm (not shown) of the aforesaid scoop.

Both the piston 14 and its rod 15 are equipped with suitable seals 16 and 17 to prevent leakage of the pressure medium. In addition, a detector element 18 is fitted in connection with the rod. The detector element is arranged to be rotated relative to its longitudinal axis in such a way that the angle of rotation corresponds to the current position of the piston relative to the cylinder barrel. The operation of the detector element is described in greater detail later, as are the connections for leading the pressure medium to the piston according to the position of the control valve.

According to the invention, the control valve is arranged in connection with the cylinder. In addition, the control valve 10 includes a rotatably supported, multi-component coaxial slide construction 39, to which the detector element 18 is connected in order to rotate the slide construction 39, when the piston 14 is in a position corresponding to the operating lever 11. Thus, independently of the position of the slide construction, the operating lever of the control valve can be turned freely, irrespective of the position of the piston. In addition, when the operating lever is turned to some position, the piston moves, until it reaches the position defined by the operating lever. In practice, the detector element then turns the slide construction the whole time while the piston moves. The piston stops, once the slide construction has rotated to the free-circulation position. The construction in question is not only extremely simple and reliable, but also easy to use and precise.

In order to connect the actuator cylinder to the pressure-medium system, there are connections 24 and 25 on essentially opposite sides of the control valve 10. Between the connections 24 and 25 a through-flow channel 40 is surprisingly also arranged. The slide construction also includes a component 27 shutting off the said through-flow channel 40. In the embodiment shown, the through-flow channel 40 is formed in the slide construction 29 and there are two connections 24 and 25. Thus, the through flow is particularly loss-free, while the position of the piston remains unchanged when the slide construction is in the free-circulation position. The construction is also simple and operationally reliable.

According to the figures, the control valve 10 is preferably arranged as part of the cylinder inside the body piece 20 forming the cylinder barrel 13. This makes the structure durable and easy to manufacture. The total length of the cylinder is also kept advantageously short. In addition, the rotational axis of the slide construction 39 is essentially the same as that of the detector element 18, which further simplifies the construction of the actuator cylinder. On the other hand, the cylinder according to the invention can be formed by adding a control valve according to the invention to the end of a conventional actuator cylinder (not shown). Here, the body piece has a completely smooth surface both externally and internally, so that it requires as little space as possible and is easy to manufacture. In the cylinder shown, there is also a support arm 21 at the end with the operating lever 11 and a large nut 22 at the opposite end to attach the cylinder to its application, for example, a jet ski. The same reference numbers are used for components that are operationally similar.

The smooth operation of the cylinder according to the invention is achieved with the aid of a special control valve, which includes the aforementioned slide construction. Surprisingly, the operating lever 11 is used to operate directly the valve body 23 of the control valve 10. In addition, the valve body 23 is also support rotatably relative to the valve body 23, and relative to the slide 19 of the slide construction 39. Thus, when the operating lever is turned, the valve body turns by a corresponding amount, while the slide remains stationary. The operation of the control valve is described in greater detail in connection with FIGS. 4*a*–4*c*.

FIGS. 2*a*–3*c* shows the control valve in the so-called free-circulation position. The piston 14 is in the position shown by the operating lever 11, so that the pressure medium flows directly from the one connection 24 of the cylinder to the other, according to FIG. 2*a*. The connections 24 and 25 are connected to the pressure-medium system and the compressed pressure medium is fed to one connection 24 while the other connection 25 is usually connection to a pressure-medium reservoir (not shown). In the figure, the pressure is depicted with the letter P and correspondingly the return flow to the tank with the letter T. The aforesaid connections according to the invention are arranged at the same level of the longitudinal direction of the cylinder barrel, on opposite sides of the cylinder barrel. In the free circulation position, the through flow in the control valve is then as short as possible and the hose runs required are correspondingly short. The through-flow channel formed in the slide construction is shown in the figure with the reference number 40.

Figures 6A, 6B:
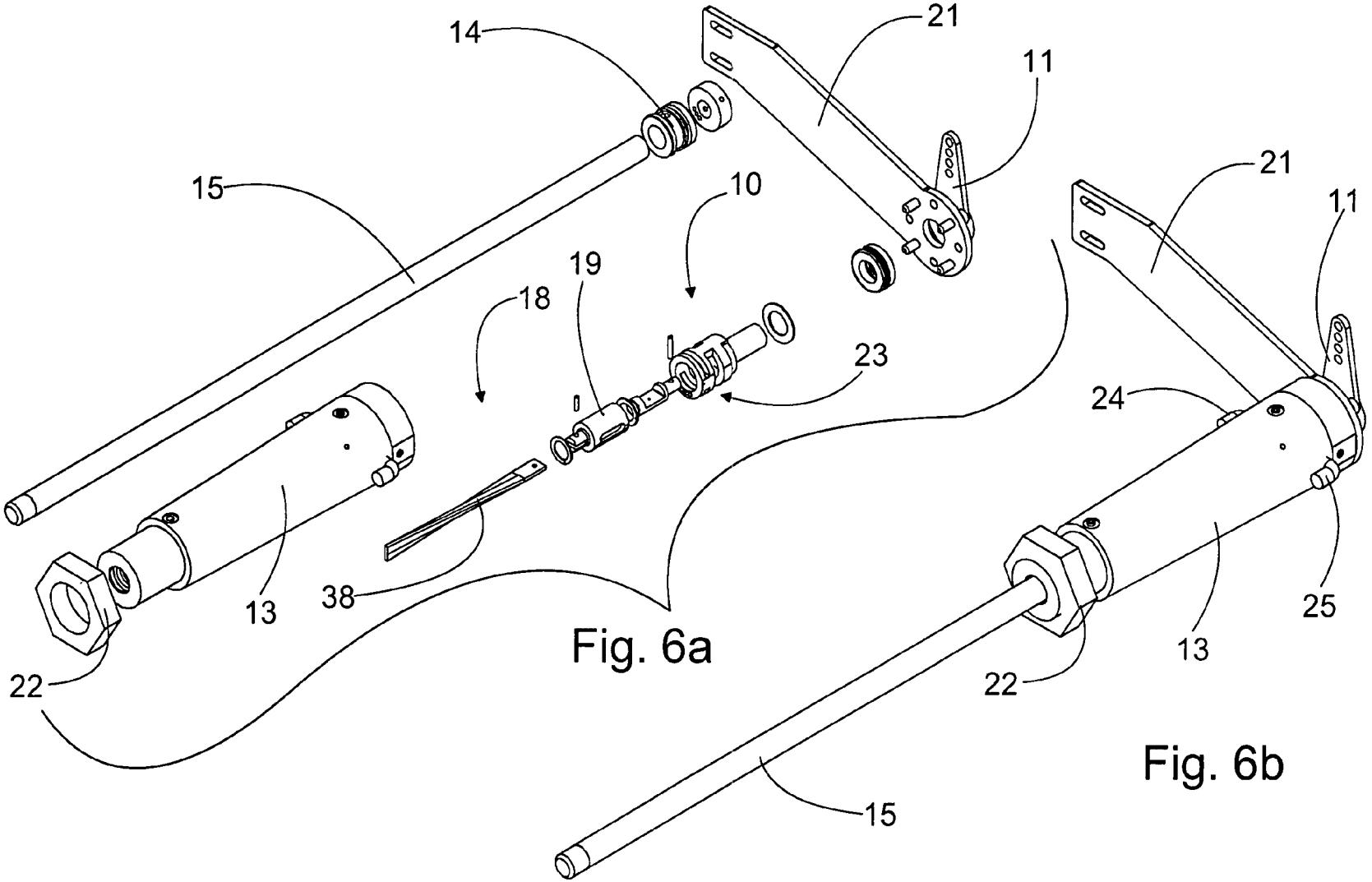
FIG. 6*a* shows an exploded perspective view of the components of the actuator cylinder according to the invention.
FIG. 6*b* shows the actuator cylinder of FIG. 6*a* with the components assembled.
Figure 7:
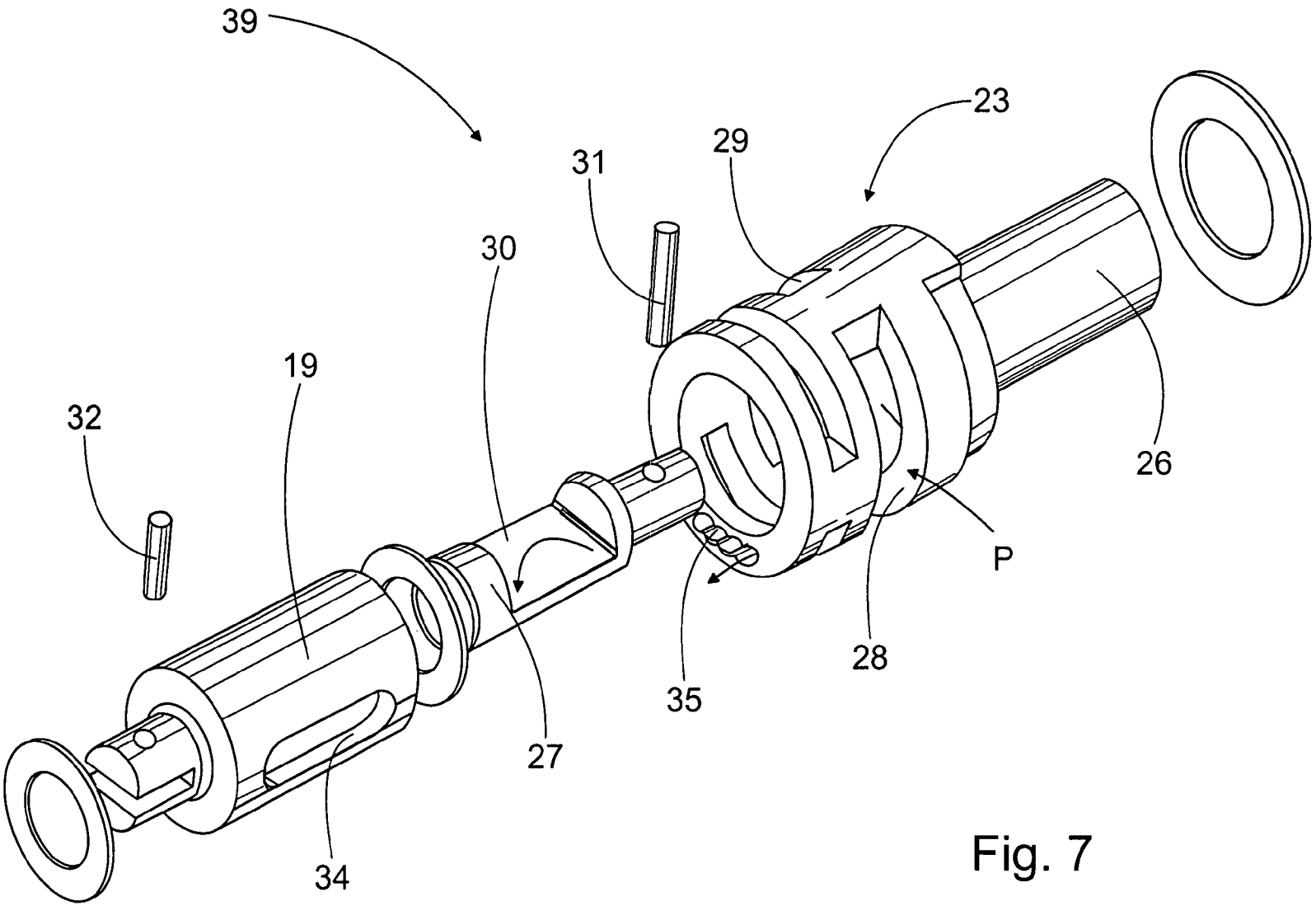
FIG. 7 shows a partial enlargement of FIG. 6*a*.

Surprisingly, the slide 19 and the valve body 23 are arranged inside each other and to be able to freely rotate relative to each other. Further, the valve body 23 includes two guide pieces 26 and 27 arranged inside each other and with cooperation. In FIG. 7, the guide pieces 26 and 27 are shown separated from each other. In addition, the slide 19 is arranged rotatably between the guide pieces 26 and 27 relative to both the valve body 23 and the cylinder barrel 13 to guide the pressure medium. With the aid of the construction in question, the control valve is made very small and reliable in operation. By arranging suitably small tolerances between the components, seals are made unnecessary, while the components are, however, lubricated the whole time, especially when hydraulic oil is used as the pressure medium. At the same time, the cylinder barrel can be completely smooth inside, the connections being formed mainly in the moving parts. In other words, part of the said connections are arranged inside the valve body. According to FIG. 7, there are channels in the guide pieces 26 and 27 that are both radial and longitudinal relative to the cylinder barrel for the pressure medium, which channels the slide 19 is arranged to close in the free-circulation position. Two openings 28 and 29, which are arranged at different heights in the longitudinal direction of the cylinder at an angle of 90° to each other, acts as channels in the outermost guide piece. Thus, the flow between the openings 28 and 29 depends on the position of the slide 19. The inner guide piece 27 is correspondingly in cooperation with the slide 19, to guide with its groove 30 the flow of the pressure medium. In practice, the guide pieces 26 and 27 are attached to each other by a pin 31, so that rotation between them is prevented. Correspondingly, the detector element 18 is attached to the slide 19 with the aid of a second pin 32 shown in FIGS. 7 and 6*a*.

As the cylinder is double acting, the pressure medium must also be led to the rod side of the piston. For this purpose the actuator cylinder includes boreholes 33, 33', and 33" arranged in the wall of the cylinder barrel 13 in the radial and longitudinal directions of the cylinder barrel 13. In the embodiment shown, the boreholes 33, 33', and 33" are made from the outer surface of the body piece 20 and then plugged. Thus, the outer surface of the body piece remains smooth, without disturbing protrusions.

Figure 4A:
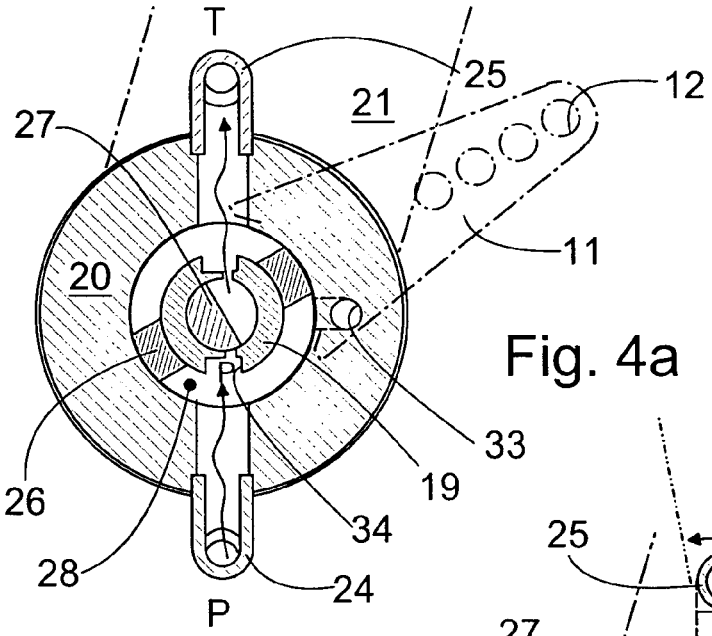
FIG. 4*a* shows a cross-section of the actuator cylinder of FIG. 1 at level A—A, when the operating lever is turned.
Figure 4B:
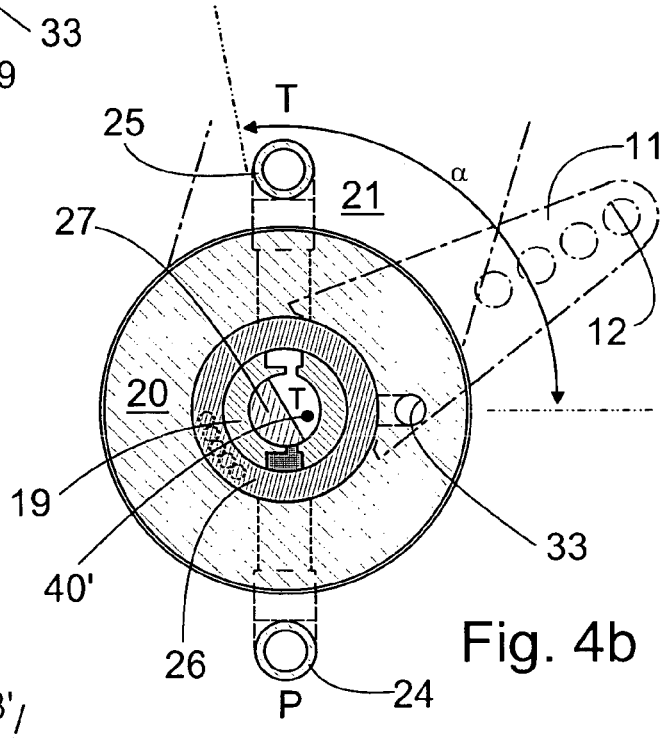
FIG. 4*b* shows a cross-section of the actuator cylinder of FIG. 1 at level B—B, when the operating lever is turned.
Figure 4C:
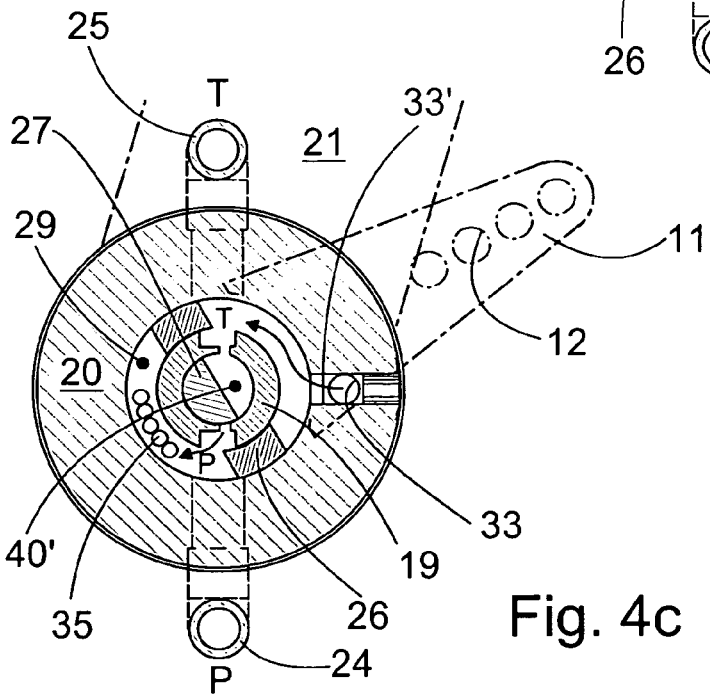
FIG. 4*c* shows a cross-section of the actuator cylinder of FIG. 1 at level C—C, when the operating lever is turned.
Figure 5:
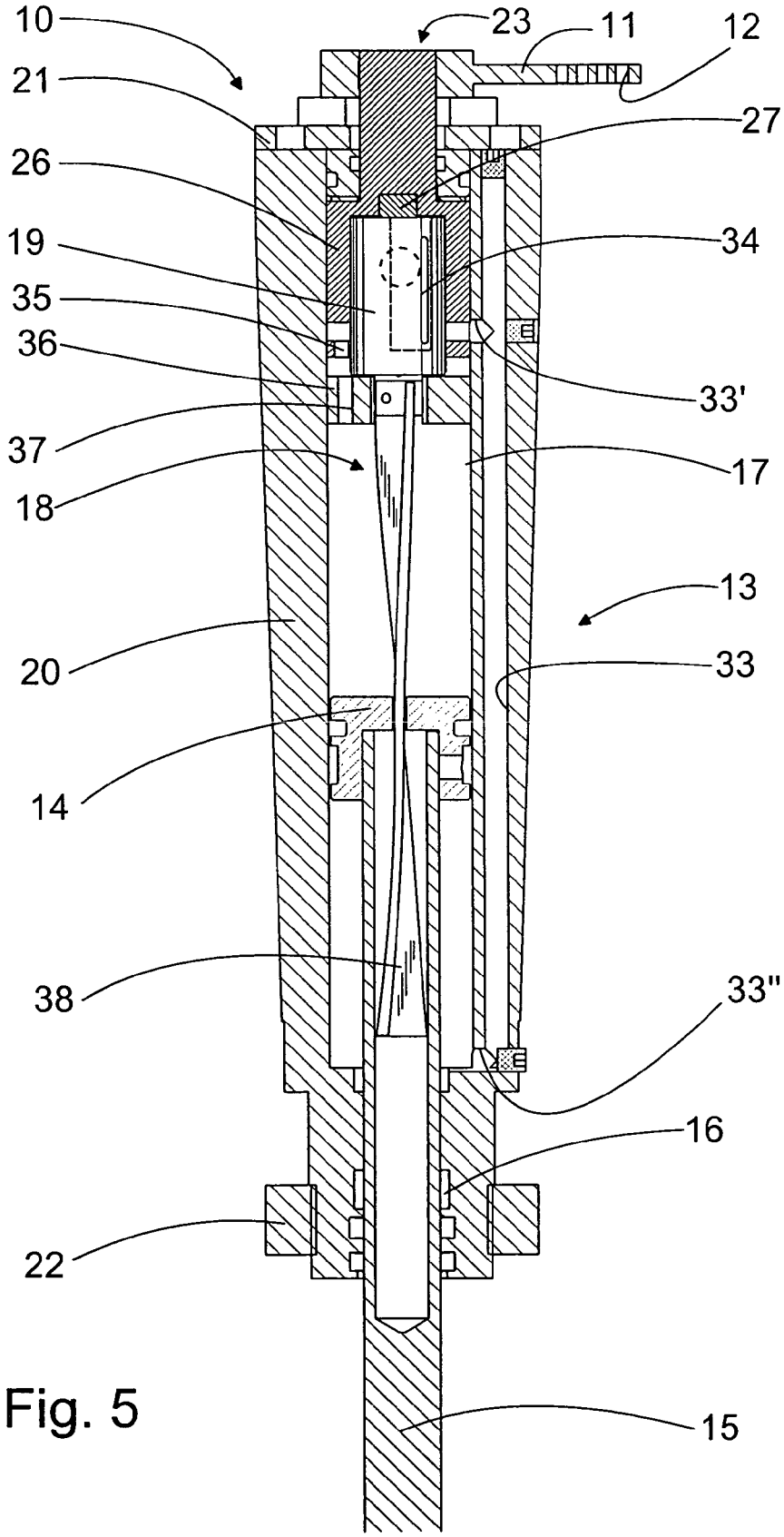
FIG. 5 shows a cross-section of the actuator cylinder according to the invention, when the piston is between the end positions.

The FIGS. 4*a*–4*c* show the situation, in which the operating lever 11 has been turned lightly counterclockwise. The slide 19 is then still in the position according to FIG. 2*a*. In other words, the piston 14 is just beginning to start moving. According to the above, the valve body 23 and its guide pieces 26 and 27 are connected to the operating lever 11 and thus follow the position of the operating lever 11. In the situation shown, the free circulation is prevented and the pressure medium flows from the connection 25 marked with the letter P into the gap 34 of the slide 19. In the gap 34, the pressure medium flows downwards towards the piston 14. This is shown by the darkened area in FIG. 4*b*. At the bottom of the gap 34, the pressure medium is able to flow to the lower opening 29 of the outer guide piece 26 and from there through the borehole 35 to the intermediate ring 36. There are boreholes 37 (FIG. 3*a*) at the corresponding point in the intermediate ring 36, through which the pressurized pressure medium reaches the piston 14, pushing it outwards. The movement of the piston 14 stops, when the detector element 18 has turned the slide 19 to the free-circulation position, according to FIG. 5. The pressure medium then flows from the connection 24 to the other directly through the gaps 34 of the slide 19 and the upper opening 28 of the outer guide piece 26. When the piston 14 moves in the direction described above, the pressure medium is able to flow from the rod 15 side of the piston 14 through the boreholes 33, 33', and 33" machined in the wall of the cylinder barrel 13 to the lower opening 29 (FIG. 4*c*) of the outer guide piece 26 and from there into the slide 19. Finally, the pressure medium flows from the upper part of the gap 34 of the slide 19 to the connection 25 leading to the tank. When the operating lever is turned clockwise, the direction of movement of the piston changes. However, the return flow has always wider flow routes than the pressure flow.

In practice, in the free-circulation position of the slide, the connections leading to and from the piston are close, so that the piston is locked into the position in question. This is also termed the holding property. The shutting off takes place particularly between the guide piece 26 and the slide 19 (FIG. 4*c*). In the embodiment shown, the outer guide piece 26 on the one hand divides the flows going in different directions and, on the other, prevents, together with the slide, flows to the piston in the free-circulation position. The slide 19 correspondingly forms either a radial or a longitudinal channel. In the free-circulation position, the slide 19 forms a through-flow channel 40 and in the operating position a longitudinal channel 40' between the openings of the guide pieces. The inner guide piece 27 prevents free circulation together with the slide 19. By means of the construction in question, the slide construction is simple, making the operation of the control valve precise and smooth.

In practice, the operating lever and the control valve are arranged so that the maximum movement of the operating lever corresponds at most to the maximum rotation of the detector element. Thus, the position of the piston always corresponds to the position of the operating lever. In principle, the length of stroke of the cylinder is independent of the said maximum rotation. With a single type of control valve it is therefore possible to use cylinders of different sizes, simply by changing the length of the detector element. The angle of rotation of the twisted slide 38 forming the detector element 18, however, affects the sensitivity of the control valve 10. The angle of rotation of the slide is preferably the same as the maximum movement of the operating lever, which forms an angle $\alpha$, which is 80°–130°, preferably 90°–120°, which essentially corresponds to the entire stroke of the rod of the actuator cylinder. Thus, the rotational movement of the operating lever covers the entire stroke of the cylinder. FIG. 6*a* shows an exploded view of the components of the cylinder and correspondingly FIG. 6*b* shows them assembled ready for installation. The slide 38 is controlled from the groove 39 (FIG. 3*b*) formed in the piston 14.

The stroke of one tested cylinder was 200 mm and the diameter of the piston was 50 mm. Using the cylinder in question, a force of nearly 20 kN was achieved when using hydraulic oil at a pressure of 100 bar. In the embodiment in question, turning the operating lever, which has a maximum movement of 100°, 1° thus corresponds to a 2-mm movement of the piston.

The cylinder according to the invention is compact and the stroke achieved with is can be easily and precisely controlled. In addition, the construction of the cylinder is simple and can be easily manufactured and serviced. The essential aspect is the possibility to turn the operating lever independently of the position of the piston. Despite this, the piston always moves and stops at the position indicated by the operating lever. Thus, it is possible to use specific paths and set the operating lever to the desired position, even before the pressure is connected.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An actuator cylinder, which is intended to be connected to a pressure-medium system and to be operated using a control valve controlled by an operating lever, which control valve is arranged in connection with the actuator cylinder, and which actuator cylinder includes a cylinder barrel and a piston sealed and arranged to move inside it, a rod attached to the piston, which rod extends outside the cylinder barrel at one end of it, a detector element fitted in connection with the rod, which detector element is arranged to be rotatable around its longitudinal axis, in such a way that its angle of rotation corresponds to the current position of the piston relative to the cylinder barrel, and connections to lead the pressure medium to the piston, according to the position of the control valve, in which actuator cylinder the control valve includes a rotatably supported and multi-part coaxial slide construction, to which the detector element is connected in order to rotate the slide construction to a free-circulation position, when the piston is in a position according to the operating lever, and in order to connect the actuator cylinder to the pressure-medium system, the control valve includes connections between which a through-flow channel is arranged, and the slide construction additionally includes a component shutting off the said through-flow channel, characterized in that, the slide construction has a three-part structure including an outer part and a middle part and an inner part, and the outer part and the inner part are attached to each other, and the middle part forming the said component is connected to the detector element, while the through-flow channel goes through the middle part.

2. An actuator cylinder according to claim 1, characterized in that the through-flow channel is formed in the slide construction, and that there are two connections arranged on opposite sides of the cylinder barrel at the same level in the longitudinal direction of the cylinder barrel.

3. An actuator cylinder according to claim 1, characterized in that the control valve is arranged to form part of the actuator cylinder inside the body piece forming the cylinder barrel, and that the axis of rotation of the slide construction is essentially the same as that of the detector element.

4. An actuator cylinder according to claim 1, characterized in that the control valve includes a valve body connected to the operating lever, which is also rotatably supported in relation to the cylinder barrel, and in which some of the said connections are arranged.

5. An actuator cylinder according to claim 4, characterized in that the slide construction includes a slide, which is arranged inside the valve body so that both can be freely rotated relative to the other, to which slide the detector element is attached.

6. An actuator cylinder according to claim 5, characterized in that the valve body includes two guide pieces set inside each other and arranged in cooperation, between which the slide is arranged rotatably in relation to both the valve body and the cylinder barrel to guide the pressure medium.

7. An actuator cylinder according to claim 6, characterized in that in the guide pieces there are channels that are both radial and longitudinal to the cylinder barrel for the pressure medium, which channels the slide is arranged to close in free-circulation position.

8. An actuator cylinder according to claim 1, characterized in that, in order to lead the pressure medium to the rod side of the piston the actuator cylinder includes boreholes that are longitudinal and radial to the cylinder barrel, arranged in the wall of the cylinder barrel.

9. An actuator cylinder according to claim 1, characterized in that the operating lever and the control valve are arranged in such a way that the maximum movement of the operating lever corresponds at most to the maximum rotation of the detector element.

10. An actuator cylinder according to claim 1, characterized in that the maximum movement of the operating lever forms an angle $\alpha$, which is 80°–130°, which essentially corresponds to the entire stroke of the rod of the actuator cylinder.

* * * * *